US012180723B2

(12) United States Patent
Faresin et al.

(10) Patent No.: US 12,180,723 B2
(45) Date of Patent: Dec. 31, 2024

(54) APPARATUS FOR PROVIDING SUPPORTING STRUCTURES FOR FLOOR SLAB FORMWORK

(71) Applicant: FARESIN FORMWORK S.P.A., Breganze (IT)

(72) Inventors: Lucia Faresin, Bassano del Grappa (IT); Chiara Faresin, Breganze (IT)

(73) Assignee: FARESIN FORMWORK S.P.A., Breganze (IT)

( * ) Notice: Subject to any disclaimer, the term of this patent is extended or adjusted under 35 U.S.C. 154(b) by 0 days.

(21) Appl. No.: 18/133,691

(22) Filed: Apr. 12, 2023

(65) Prior Publication Data

US 2023/0243166 A1 Aug. 3, 2023

(51) Int. Cl.
*E04G 11/48* (2006.01)

(52) U.S. Cl.
CPC ..... *E04G 11/48* (2013.01)

(58) Field of Classification Search
CPC ..... E04G 11/48; E04G 11/483
See application file for complete search history.

(56) References Cited

U.S. PATENT DOCUMENTS 6,161,359 A * 12/2000 Ono ..... E04G 1/14 52/646
7,640,871 B2 * 1/2010 Arozena Bergaretxe ..... E04G 11/486 108/150
8,616,519 B2 * 12/2013 Bacon ..... E04G 25/00 249/18
10,053,875 B1 8/2018 Baron et al.
10,352,052 B2 * 7/2019 Faresin ..... E04G 11/52
10,407,925 B2 * 9/2019 Baron ..... E04G 25/065
10,487,521 B2 * 11/2019 Baron ..... E04G 11/52
10,883,283 B2 * 1/2021 Faresin ..... E04G 11/50
11,105,105 B2 * 8/2021 Charitou ..... E04G 9/02
11,225,802 B2 * 1/2022 Charitou ..... E04G 11/38
11,268,289 B2 * 3/2022 Bond ..... E04G 11/38
(Continued)

FOREIGN PATENT DOCUMENTS

CA 2 994 076 A1 8/2019
DE 29 27 116 A1 1/1981
(Continued)

OTHER PUBLICATIONS

Italian Search Report dated Aug. 258, 2022 received in Italian Application No. IT 202200000569.

*Primary Examiner* — Eret C McNichols
(74) *Attorney, Agent, or Firm* — Scully, Scott, Murphy & Presser, P.C.

(57) ABSTRACT

An apparatus for providing supporting structures for floor slab formwork, which comprises at least one beam with at least one end portion which has:

a pair of mirror-symmetrical walls, which are plate-like and vertical with respect to the installation position of the beam and are crossed by a crossmember which protrudes externally from the mirror-symmetrical walls with respective external portions, an L-shaped element, between the pair of mirror-symmetrical walls, with a vertical portion that is directed downward, with respect to the installation position of the beam, and protrudes, in the direction of longitudinal extension of the beam, from the pair of mirror-symmetrical walls and above the crossmember.

12 Claims, 13 Drawing Sheets

(56) References Cited

U.S. PATENT DOCUMENTS

| | | | | |
|---|---|---|---|---|
| 11,384,546 | B2 * | 7/2022 | Becker | E04G 11/486 |
| 11,686,108 | B2 * | 6/2023 | Charitou | E04G 11/38<br>249/50 |
| 11,976,477 | B2 * | 5/2024 | Becker | E04G 17/005 |
| 2004/0075043 | A1 * | 4/2004 | Arozena Bergaretxe | E04G 11/38<br>249/210 |
| 2012/0042600 | A1 * | 2/2012 | Bacon | E04G 25/00<br>52/632 |
| 2019/0010716 | A1 * | 1/2019 | Baron | E04G 25/061 |
| 2019/0112824 | A1 * | 4/2019 | Charitou | E04G 11/52 |
| 2022/0098882 | A1 * | 3/2022 | Charitou | E04G 11/52 |
| 2022/0372774 | A1 * | 11/2022 | Ubiñana Félix | E04G 11/50 |

FOREIGN PATENT DOCUMENTS

| | | | | |
|---|---|---|---|---|
| EP | 1617013 | A1 * | 1/2006 | E04G 11/38 |
| WO | 2020/089951 | A1 | 5/2020 | |

* cited by examiner

APPARATUS FOR PROVIDING SUPPORTING STRUCTURES FOR FLOOR SLAB FORMWORK

The present invention relates to an apparatus for providing supporting structures for floor slab formwork.

The invention is applicable in the building field, in the sector of apparatuses for buildings.

Currently, numerous building apparatuses adapted to allow the provision of floor slabs are known. Said floor slabs are normally provided by installing beforehand formwork within which a casting, typically of concrete, is to be performed.

In order to install formwork, multiple props are rested on the ground and supporting heads for beams for supporting formwork panels are installed on each one of them. The supporting heads are each installed by means of a post to be fixed to the end of the respective prop and heads of the fixed type or heads of the drop type, adapted to be removed from below after the casting, can be used.

In order to provide appropriate support to the formwork it is necessary to provide a framework of main beams and secondary beams.

Currently, it is common to use main beams with a wing for each side which, by extending along the length of the beam, provides a lateral supporting channel for the secondary framework.

Both primary and secondary beams can be provided with heads at the ends, which allow them to rest on the supporting head and on the wings of the primary beams already installed, in order to form the framework. Said framework is completed with wood boards nailed only to the secondary beams, which for this purpose may have a main body made of wood or be provided with an upper insert made of wood.

Supporting heads of the drop type are often used. A drop-type supporting head comprises, on at least two mutually opposite sides of the post, pairs of parallel, mirror-symmetrical plates, which are contoured with recesses for the resting of an end portion of a primary or secondary beam. Preferably, the drop head is provided with pairs of plates on either side of the post.

Each end portion of the beams has a pair of vertical walls crossed by a crossmember, which protrudes from said walls to rest at the recesses present in the plates, and also has a substantially hook-shaped portion which is directed downward for engagement in the lateral channel of a primary beam.

During the provision of the framework, the beams are rested with one end on the drop head or the lateral channel of a primary beam, installed previously, and are then lifted at the other end as well and brought to rest on another drop head or a lateral channel of another primary beam which is parallel to the previous one. Until this operation is completed, the beams are unstable and can disengage or slide off, accidentally falling downward.

Accidental falls can also occur during stripping, due to the fact that the lowering of two contiguous drop heads does not occur simultaneously and, therefore, can cause the beams to accidentally fall downward instead of onto the lowered heads. The same drawback can be found in the lowering of primary beams, which can induce the accidental fall to the ground of the secondary beams that rest on them with their ends.

The aim of the present invention is to provide an apparatus for providing supporting structures for floor slab formwork that is capable of improving the background art in one or more of the aspects mentioned above.

Within this aim, an object of the invention is to propose an apparatus that allows the installation of a framework of formwork beams with greater safety than hitherto known apparatuses.

Another object of the invention is to propose an apparatus with which to facilitate and increase the safety of the stripping step, with removal of the beams and of the supporting heads after the casting.

A further object of the present invention is to overcome the drawbacks of the background art in a manner that is alternative to any existing solutions.

Not the least object of the invention is to provide an apparatus that is highly reliable, relatively easy to provide and at competitive costs.

This aim and these and other objects that will become more apparent hereinafter are achieved by an apparatus for providing supporting structures for floor slab formwork, characterized in that it comprises at least one beam with at least one end portion having:

- a pair of mirror-symmetrical walls, which are plate-like and vertical with respect to the installation position of said beam and are crossed by a crossmember which protrudes externally from said mirror-symmetrical walls with respective external portions,
- an L-shaped element, between said pair of mirror-symmetrical walls, with a vertical portion that is directed downward, with respect to the installation position of said beam, and protrudes, in the direction of longitudinal extension of said beam, from said pair of mirror-symmetrical walls and above said crossmember.

Further characteristics and advantages of the invention will become more apparent from the description of a preferred but not exclusive embodiment of the apparatus according to the invention, illustrated by way of non-limiting example in the accompanying drawings, wherein.

Figure 6:
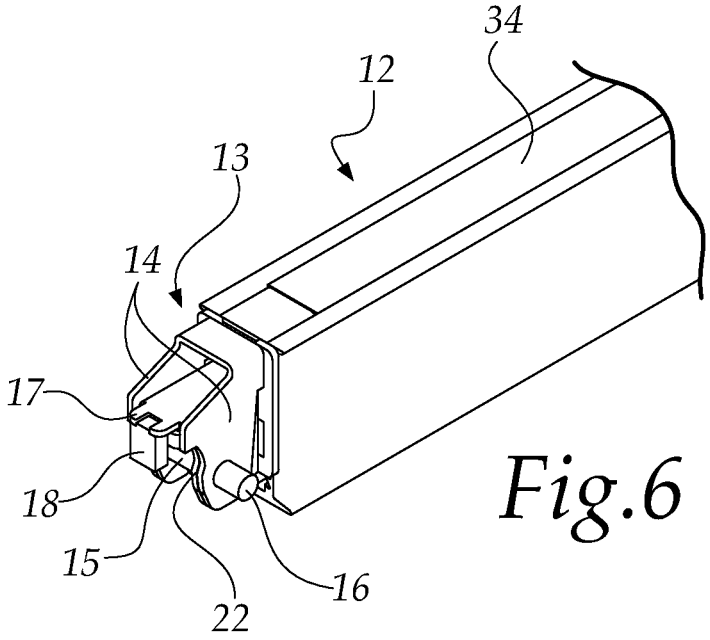
FIG. 6 is a view of an end portion of another beam.
Figure 7:
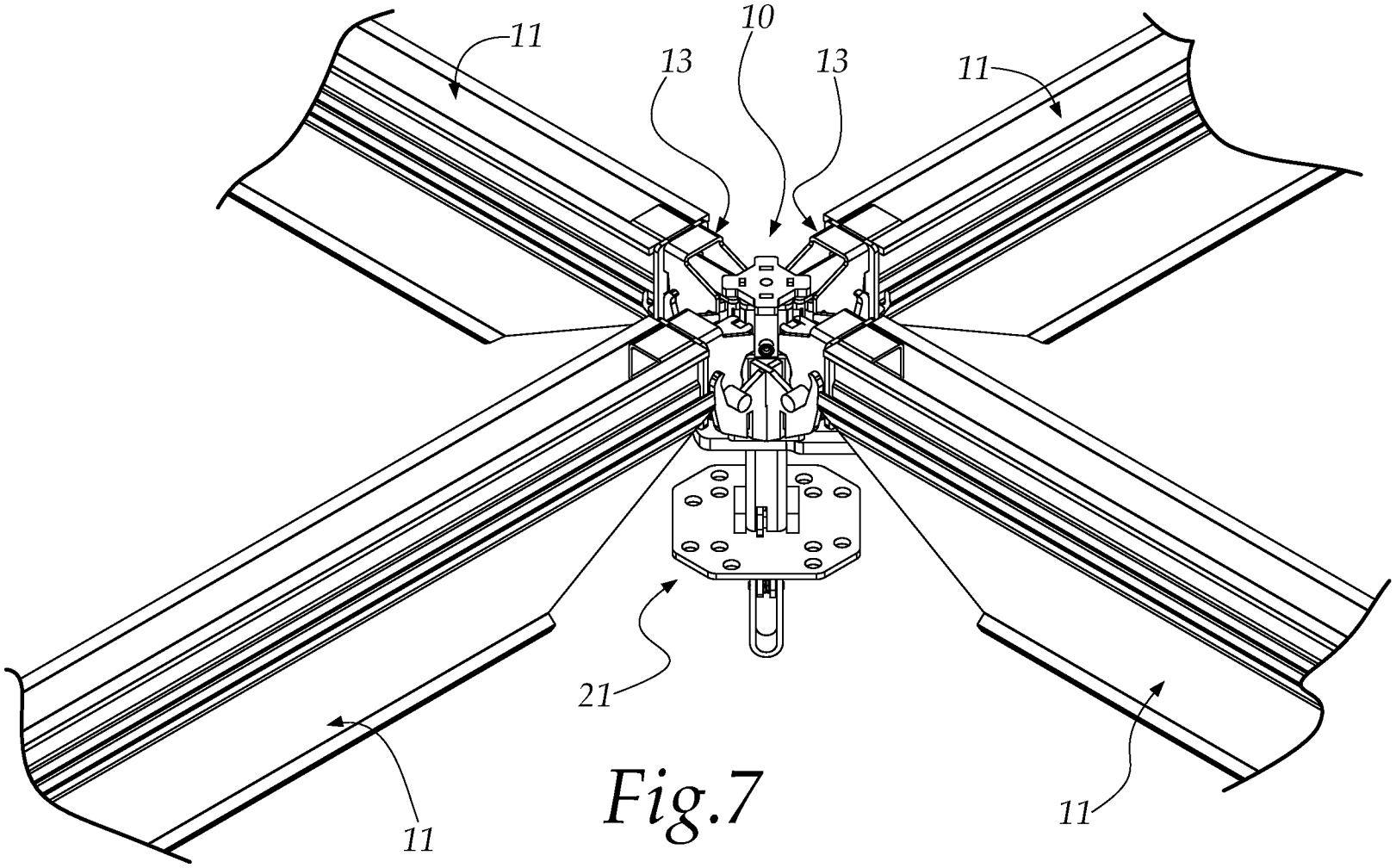
FIG. 7 is a view of an example of association of beams with a supporting head by means of the apparatus according to the invention.
Figure 12A:
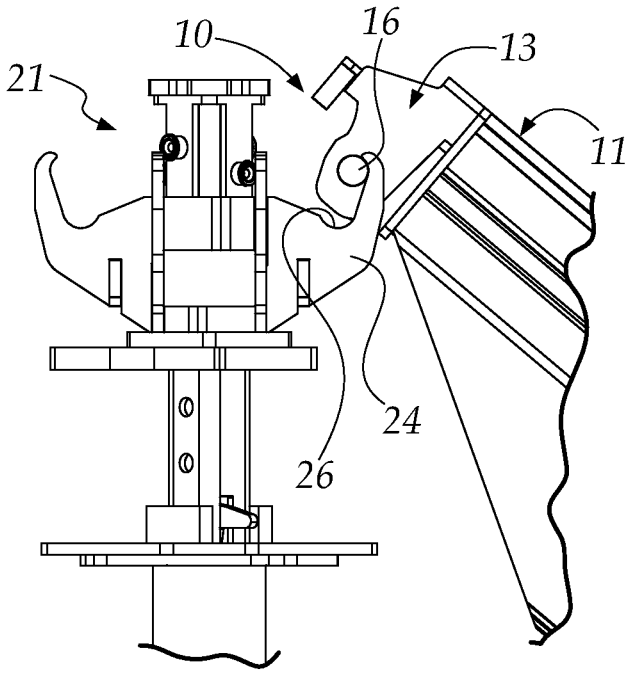
Figure 12B:
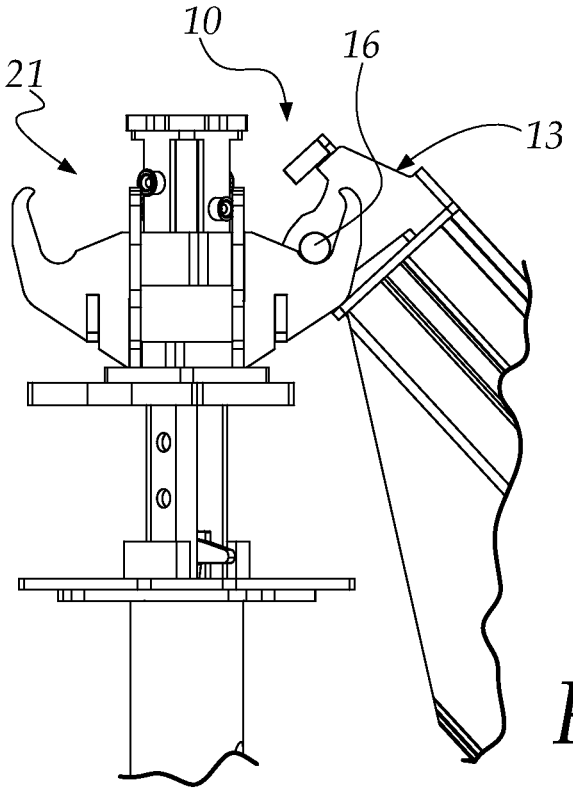
Figure 12C:
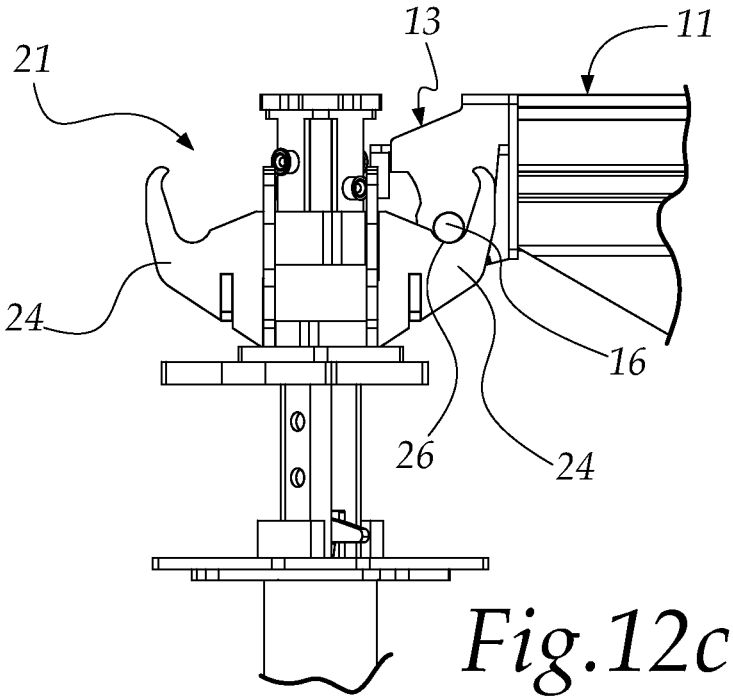
Figure 13:
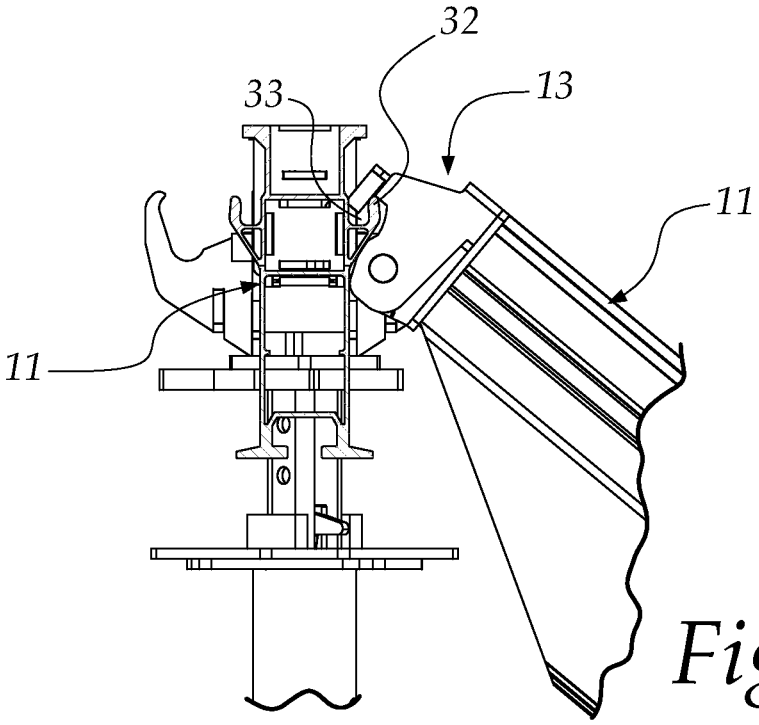
Figure 16:
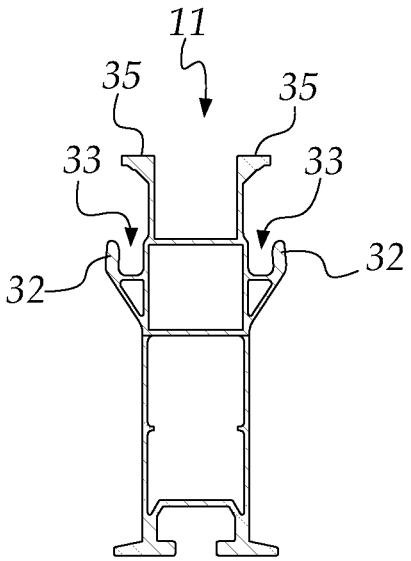
Figure 17:
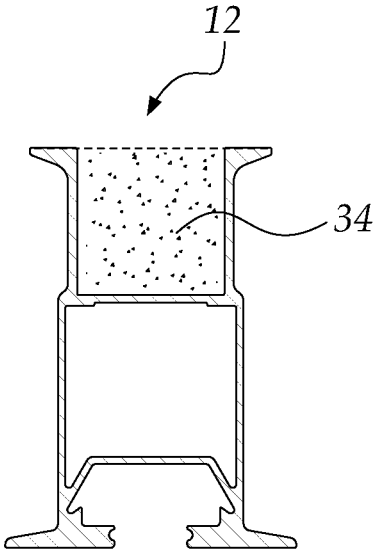
Figure 18:
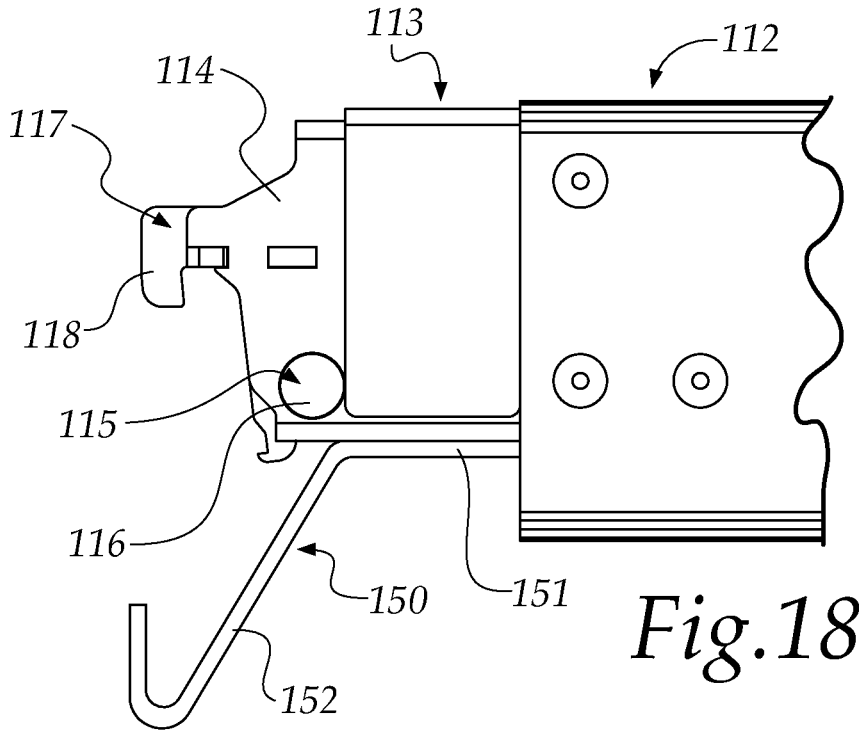
Figure 19:
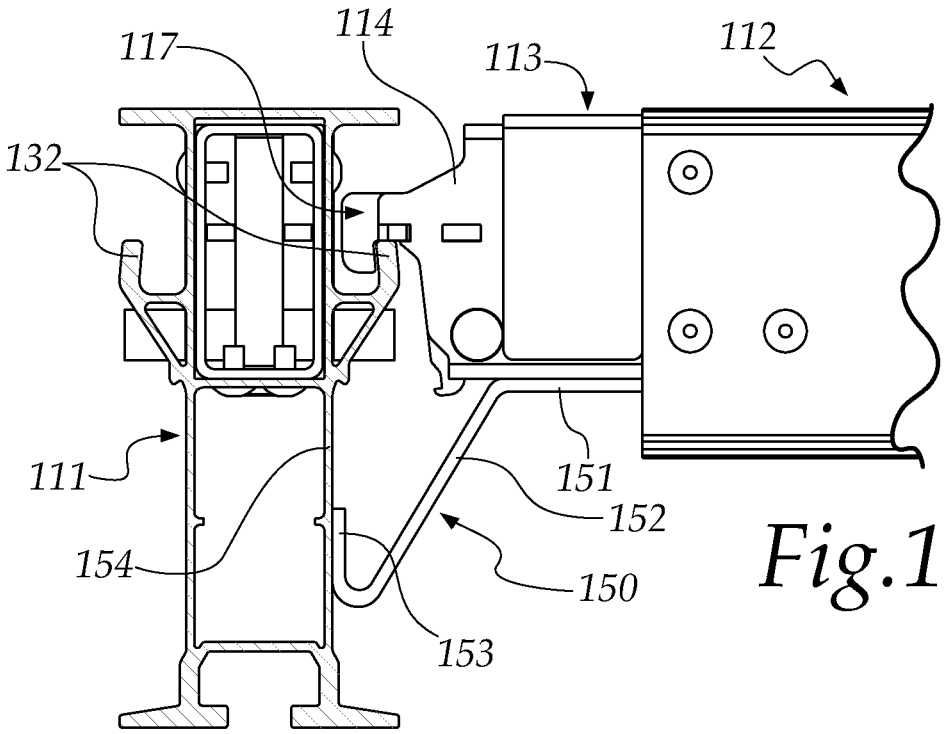

FIGS. 12*a*, 12*b* and 12*c* are views of subsequent steps of the coupling of a beam to a supporting head by means of the apparatus according to the invention;

FIG. 13 is a view of a step of coupling between two beams by means of the apparatus according to the invention;

FIGS. 14*a* to 14*e* are views of consecutive steps of the lowering of two supporting heads and of a beam coupled thereto during stripping;

FIGS. 15*a* to 15*d* are views of consecutive steps of the lowering of two beams and of another beam coupled thereto during stripping;

FIG. 16 is a transverse sectional view of a beam;

FIG. 17 is a transverse sectional view of another beam;

FIG. 18 is a side view of an end portion of a second embodiment of the beam of FIG. 6;

FIG. 19 is a side view of the end portion of FIG. 18, in an application for use.

With reference to the figures, the apparatus according to the invention, generally designated by the reference numeral 10, comprises beams that can be of the primary type, designated in the figures by the reference numeral 11, and of the secondary type, designated in the figures by the reference numeral 12. The objects and possible uses of the two types of beams are known in the field. A primary beam 11 and a secondary beam 12 are shown in transverse cross-section in FIGS. 16 and 17, respectively. In both cases, the beams 11, 12 can have an end portion 13, at one or preferably both ends, which has:

- a pair of mirror-symmetrical walls 14, which are plate-like and vertical with respect to the installation position of the beam 11, 12 and are crossed by a crossmember 15, preferably a rod, which protrudes externally from the mirror-symmetrical walls 14 with respective external portions 16,
- an L-shaped element 17, between the pair of mirror-symmetrical walls 14, with a vertical portion 18 that is directed downward, with respect to the installation position of the beam 11, 12, and protrudes, in the direction of longitudinal extension of said beam 11, 12, from the pair of mirror-symmetrical walls 14 and above the crossmember 15.

Figure 1:
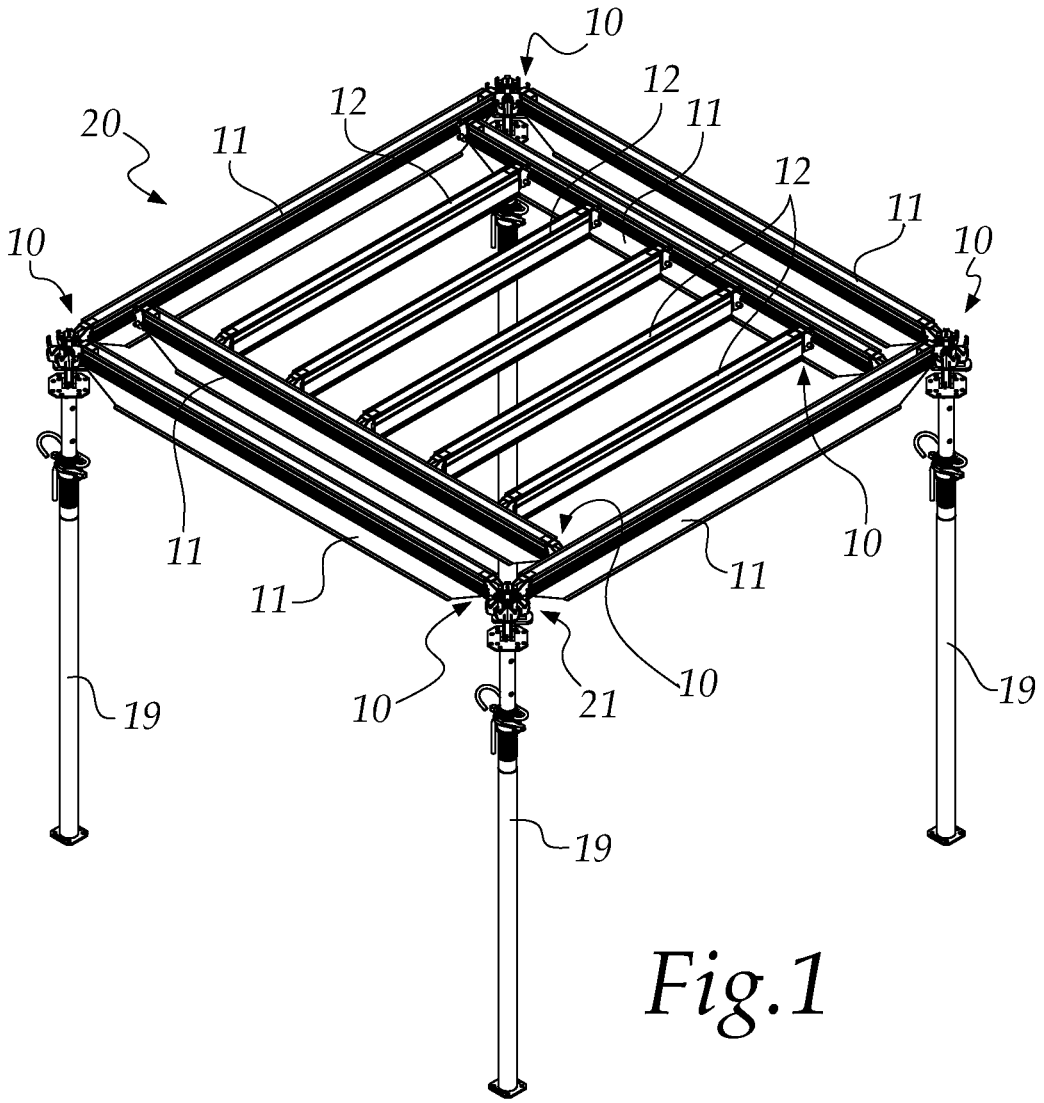
FIG. 1 is a view of a supporting structure provided with the apparatus according to the invention.
Figure 2:
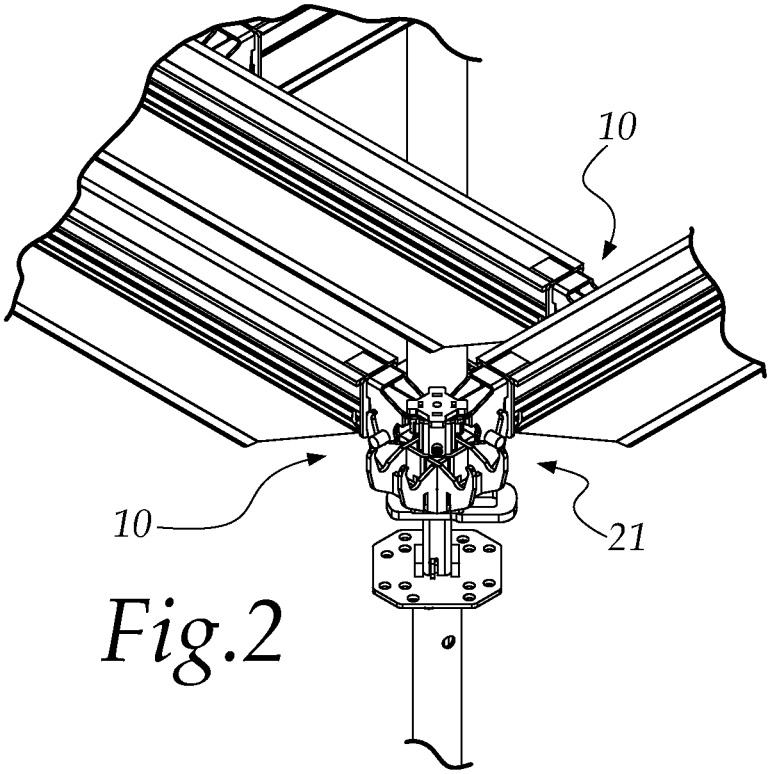
FIG. 2 is an enlarged-scale view of a portion of the structure shown in FIG. 1.
Figure 3:
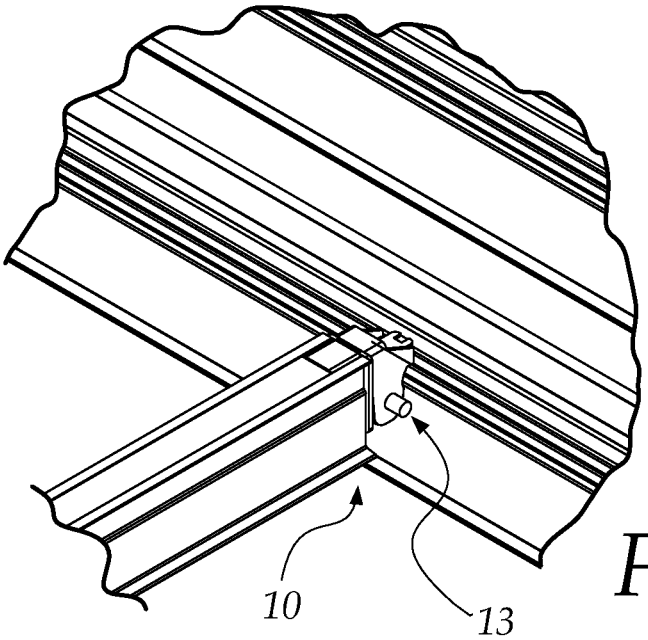
FIG. 3 is another enlarged-scale view of another portion of the structure shown in FIG. 1.

By means of the apparatus 10 it is possible to provide a supporting structure such as the framework shown in FIG. 1 and designated in general by the reference numeral 20, in which there are props 19 on which supporting heads 21 of the drop type, primary beams 11 and secondary 20 beams 12 are associated.

In the example, the perimetric primary beams 11 are coupled at their ends to supporting heads 21, other primary beams 11 are coupled with their ends to respective sides of two perimetric primary beams 11, and the secondary beams 12 are coupled, parallel to each other, with their ends to the respective sides of primary beams 11.

The manner in which these couplings occur is facilitated by the apparatus 10 according to the invention, as will become more apparent hereinafter.

Figure 5:
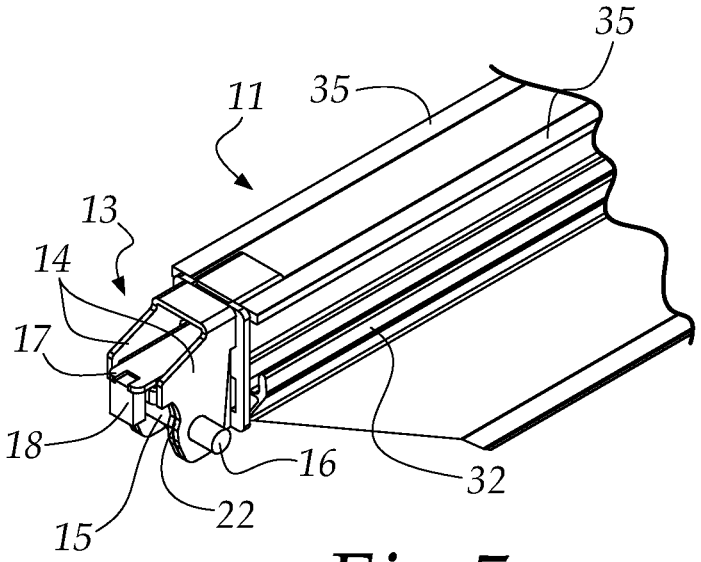
FIG. 5 is a view of a beam end portion.

The mirror-symmetrical walls 14 belong to a metal plate folded in an inverted U-shape, as shown at least by FIGS. 5 and 6, and each wall has a recess 22 which, with the vertical portion 18 of the L-shaped element 17, defines a hollow for the end of the beam 11, 12.

Figure 4:
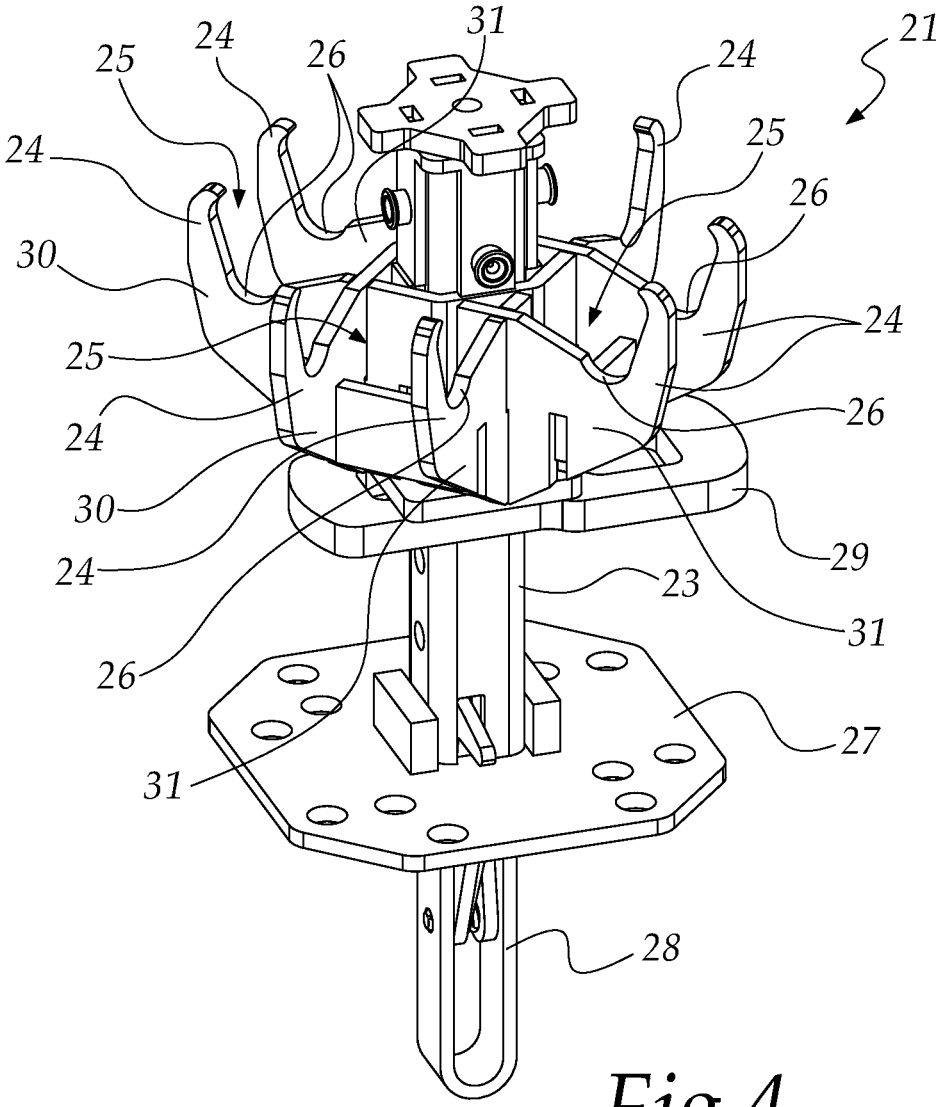
FIG. 4 is a perspective view of a supporting head of the apparatus according to the invention.

The apparatus 10 also comprises the supporting heads 21. Each supporting head 21, shown individually in FIG. 4, comprises in turn a post 23 and a pair of plates 24 at each of at least two mutually opposite parts of the post 23, which are arranged mirror-symmetrically with respect to each other and are adapted to delimit laterally a region 25 for the accommodation of the end portion 13 of the beam 11, 12 with its pair of mirror-symmetrical walls 14. Each pair of plates 24 is provided with recesses 26 for guiding insertion and containment for the external portions 16 of the crossmember of said beam 11, 12.

Both types of beams 11, 12, therefore both the primary one and the secondary one, can be provided with an end portion 13 as described above, which allows the same type of coupling to the supporting heads 21.

In particular, with the supporting head 21 shown it is possible to couple up to 4 beams 11 or 12, comprising a pair of plates 24 at each of four parts of the post 23 and in pairs on mutually opposite parts of said post 23.

The post 23 extends upward from a fixing plate 27 to a complementary plate of the prop 19 and a shank 28 to be inserted in the prop 19 extends instead in the lower part. The coupling of the supporting head 21 with a prop 19 occurs in a manner known per se and with means known per se.

Reversible means 29, of a type known per se, for locking the supporting head are also present which are adapted to facilitate also the lowering of the head during the stripping step. During the lowering step, the upper part of the supporting head 21 slides on the post 23 toward the fixing plate 27.

The post 23 has a substantially quadrangular cross-section and the pairs of plates 24 are positioned on planes which are inclined at 45° with respect to the faces of the post 23.

In particular, the pairs of plates 24 are defined by:

- two first metal plates 30, which are each bent so as to form two portions on perpendicular planes and intersect each other so as to form an internal space in which the post 23 is placed,
- two pairs of second metal plates 31.

In each pair, the second metal plates 31 intersect each other at right angles and the pairs are positioned on mutually opposite parts of the post 23.

The beam 11, i.e., the primary beam, has at least one lateral external wing 32 that is directed upward and is extended along the length of said beam 11 so as to form a corresponding lateral insertion channel 33 for the vertical portion 18 of the end portion 13 of another beam 11 or 12, retaining it in any horizontal translational motion. This type of coupling is shown in FIG. 8, where a primary beam 11 is coupled with its end portion 13 to another primary beam 11, at the lateral channel 33 thereof, and in FIG. 11, where a secondary beam 12 is coupled with its end portion 13 to a primary beam 11 in the same manner as described above for the previous ones.

Figure 8:
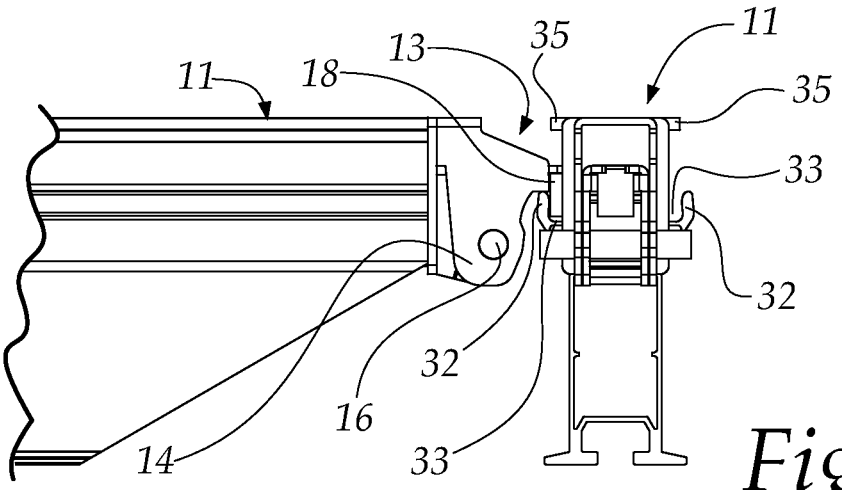
FIG. 8 is a view of the coupling between two beams by means of the apparatus according to the invention.
Figure 11:
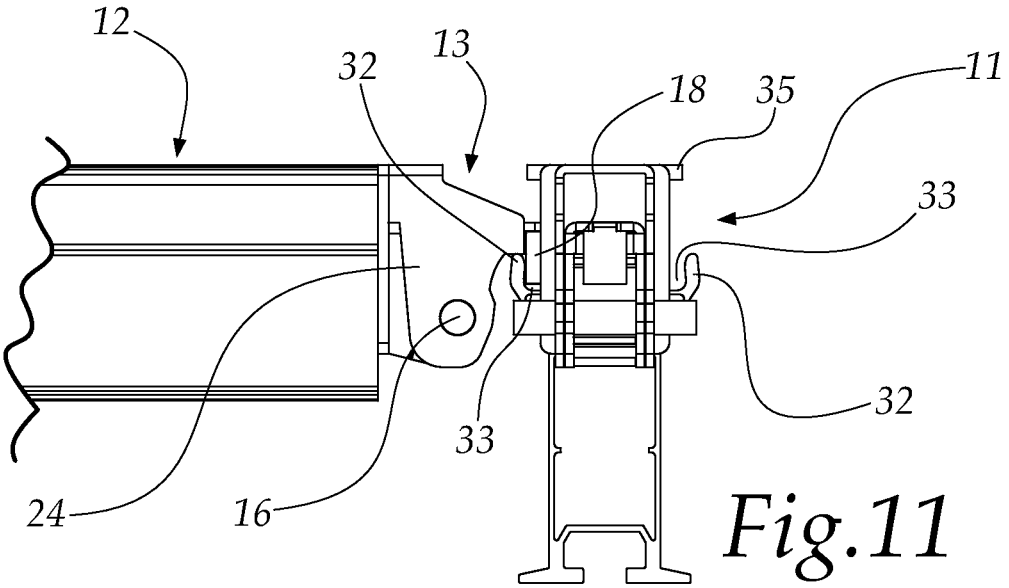
FIG. 11 is a view of the coupling between two beams by means of the apparatus according to the invention.

The end portion 13 is adapted to rest on the lateral external wing 32 also by means of the recess 22 of each of the mirror-symmetrical walls 14, as can be seen again from the examples shown in FIGS. 8 and 11.

Figure 9:
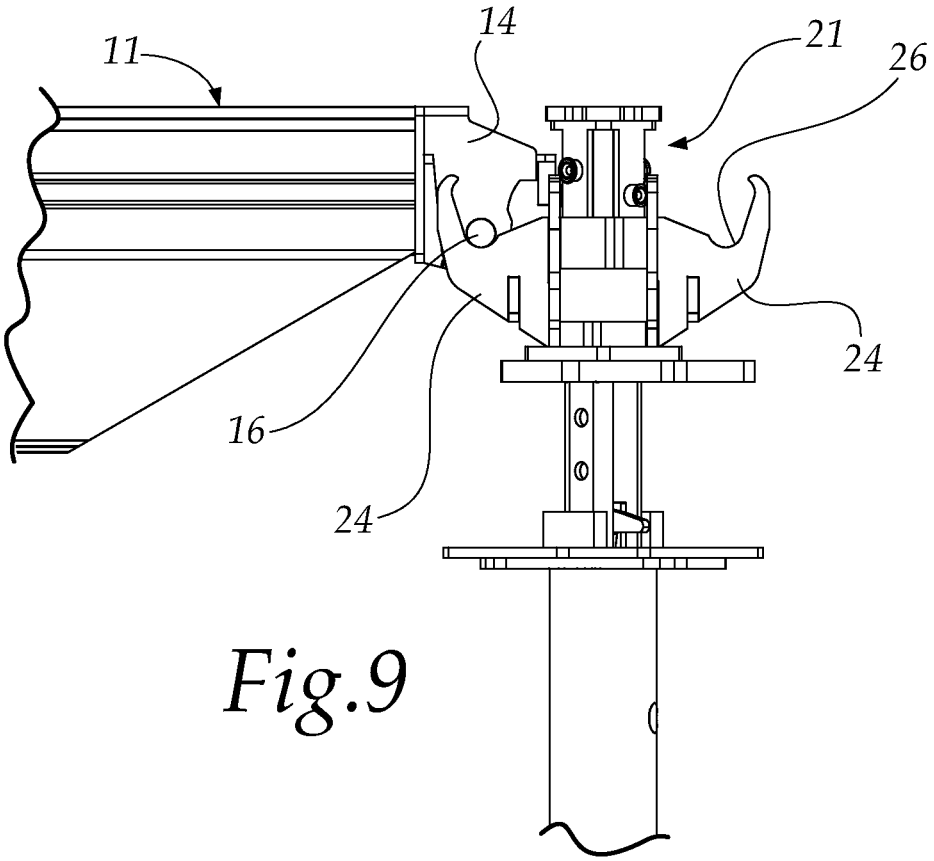
FIG. 9 is a view of the coupling between a beam and a supporting head by means of the apparatus according to the invention.
Figure 10:
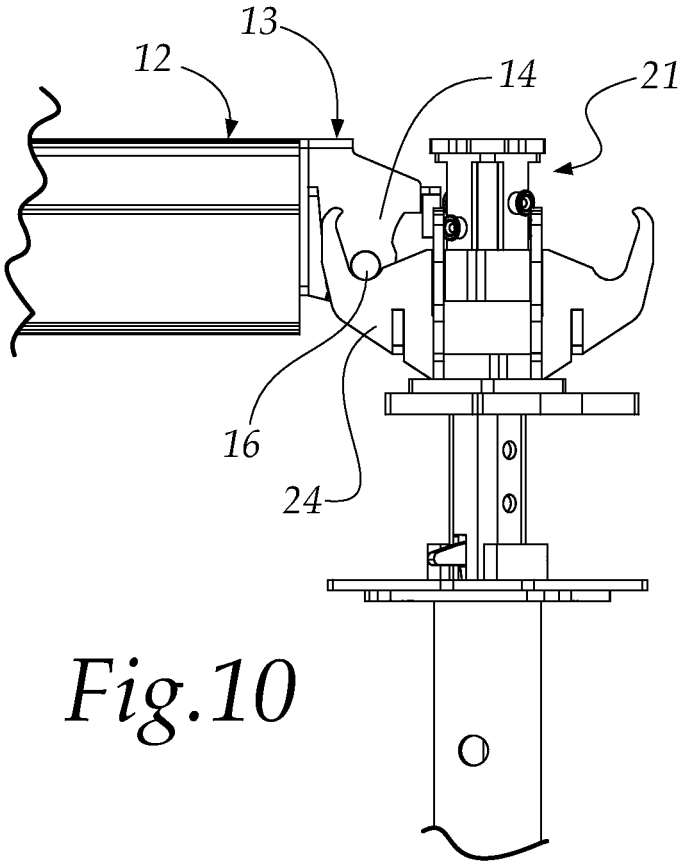
FIG. 10 is a view of the coupling between another beam and a supporting head by means of the apparatus according to the invention.

FIGS. 9 and 10 show instead the coupling of a beam 11 or 12, in the two cases a primary beam and a secondary beam respectively, to a supporting head 21.

As shown in the figures, while the primary beam 11 has a particularity in that it is provided with two lateral external wings 32, one for each side, the secondary beam 12 has an upper channel filled with an insert 34 (designated in FIG. 6 and FIG. 17) made of preferably recycled plastic material or, as an alternative, made of wood. As an alternative, said insert can be made of wood, as already known in the field. In a manner known per se, the formwork can be completed with panels made of wood to be nailed onto the secondary beams at their inserts.

The primary beams 11 also have, as is visible in particular in the sectional views, upper wings 35 which are directed outward and are extended along its entire length.

The use of the apparatus, according to the invention, is as follows. FIGS. 12*a*, 12*b* and 12*c* show different steps of assembly with coupling of a beam 11, of the primary type, to a supporting head 21.

The same steps apply for the coupling of a secondary beam, since said beams are provided with a similar end portion 13.

During assembly, one end of the beam 11 is arranged on the supporting head 21, while the other end is lifted in a subsequent step. The particular shape of the plates 24, particularly the recesses 26 in which the external portions 16 of the crossmember 15 are gradually positioned, prevent accidental extraction of the beam 11, both during positioning, up to the positioning of the external portions 16 on the bottom of the recesses 26, and when installation is completed, therefore preventing also the accidental fall of the beam even if it is installed only temporarily with a portion thereof.

FIG. 13 shows the assembly of a beam 11 with coupling to another beam of the same type and already previously installed, therefore at the lateral channel 33.

In this case also, the same type of coupling can occur between a secondary beam 12 and a primary beam 11.

The lateral channel 33 allows the accommodation of the vertical portion 18. For this operation to take place safely, the primary beams 11 which are rested with their two ends on supporting heads 21 (like the perimetric ones in the example of FIG. 1) are retained also in rotation along their own longitudinal axis of extension. Said rotational retention is provided by the shape of the vertical plates 24 and by the shape of the pair of mirror-symmetrical walls 14 of the end portion 13, which are inserted between the two previous ones, and by the crossmember 15 in the recesses 26, which contributes to maintain the relative position between the head and the beam.

The retention thus obtained, by preventing rotation about the longitudinal axis of the primary resting beams, also locks the rotation of the beams, which can be primary or secondary, engaged at the lateral channels of the resting ones, thus avoiding the possibility of falling during the assembly step. Substantially, the rotational retention ensures that the weight of the beam that is installed cannot make the beam on which it rests rotate.

During the stripping step, the lowering of the movable part of the supporting head 21, which is of the drop type, ensures that the beams that rest thereon also are lowered so that they can then be removed from the system.

Said lowering occurs instantaneously for the primary beams, while for the secondary beams it might occur at a later time, since the wood panel 36 on which the concrete casting occurs is fixed by nails on the insert 34. During the stripping step, therefore, the nails might keep the secondary beams in the raised position and said secondary beams might lower after a certain period of time or due to the intervention of an operator. The height of the plates of the drop head, with their shape due to the recesses 26, is such as to ensure that the beams fall back into them, preventing them from being able to accidentally slip out, disengage and fall to the ground. A primary beam, instead, since it is not nailed to the wood panel, moves downward simultaneously with the movable part of the supporting head.

Figure 14A:
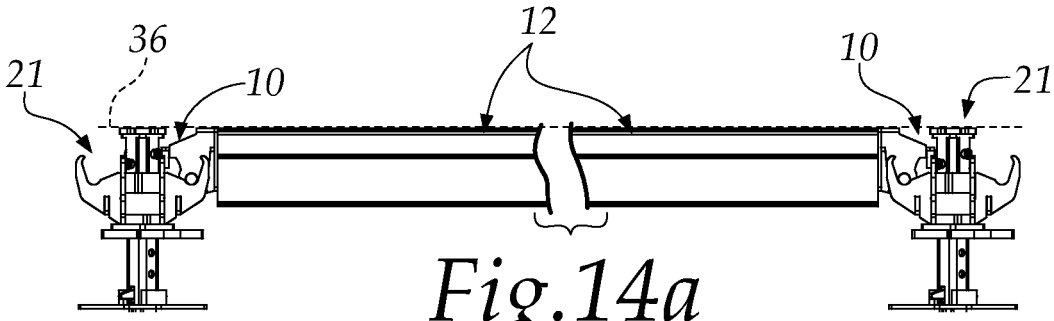
Figure 14B:
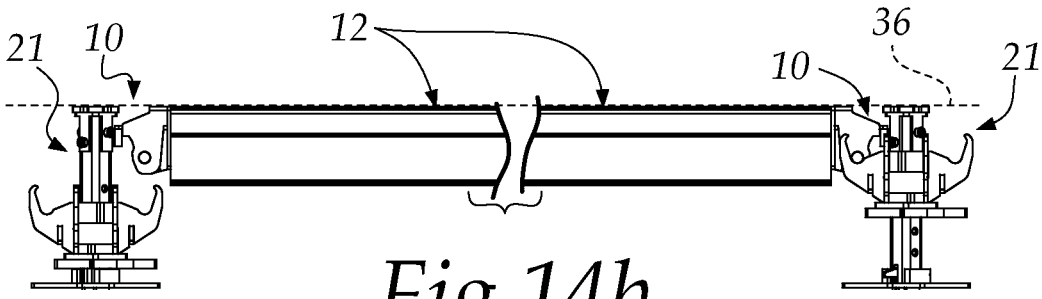

FIGS. 14*a* to 14*e* show the lowering steps of supporting heads 21 and of a secondary beam 12, if it is nailed in an upper region to the formwork panel 36, therefore if the lowerings do not occur simultaneously. FIG. 14*a* shows the initial situation, while FIG. 14*b* shows the lowering of a first supporting head 21. The beam 12 can remain lifted because it is retained by the nails that are present in the overlying panel 36.

Figure 14C:
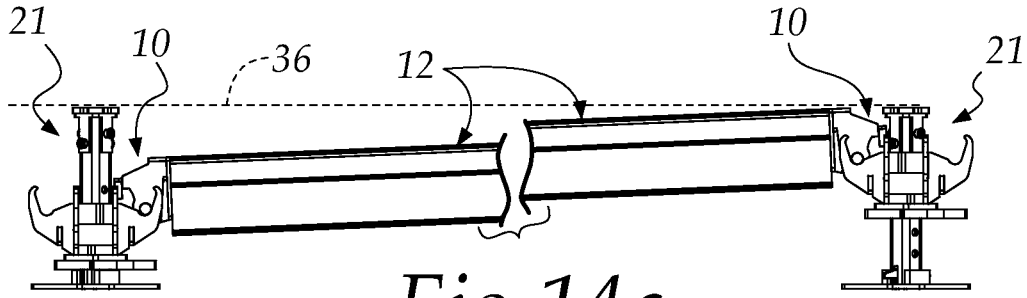

FIG. 14*c* shows the lowering of a secondary beam end, during which the secondary beam falls back onto the drop head and not accidentally to the ground.

Figure 14D:
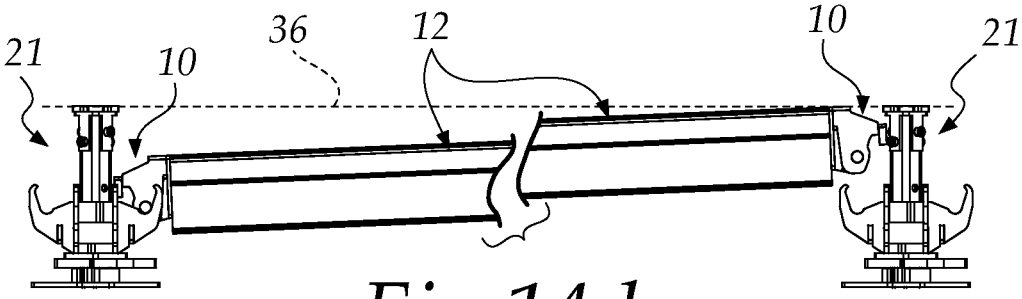

FIG. 14*d* shows the lowering of the second supporting head 21 and the fact that the beam 12 can once again remain raised because it is retained by nails provided in the panel 36.

Figure 14E:
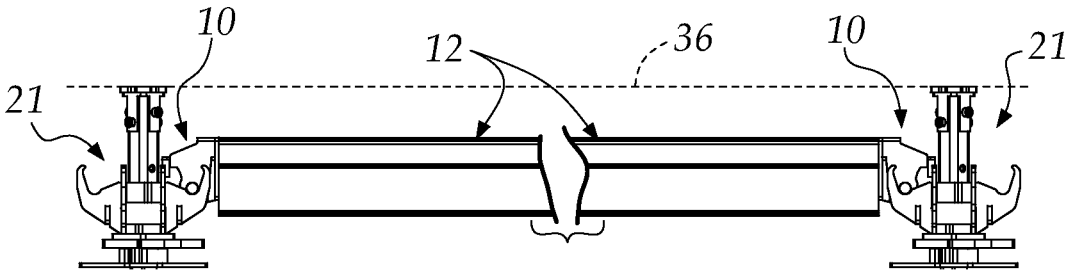
Figure 15A:
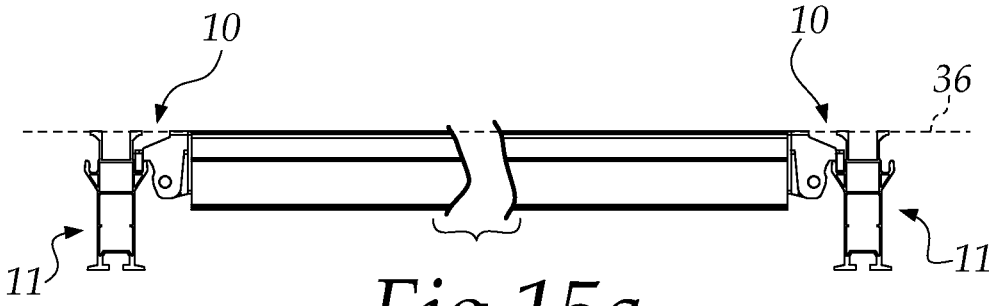
Figure 15B:
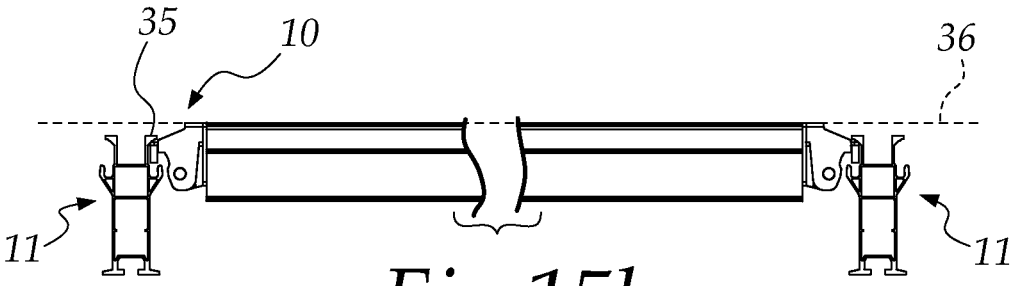
Figure 15C:
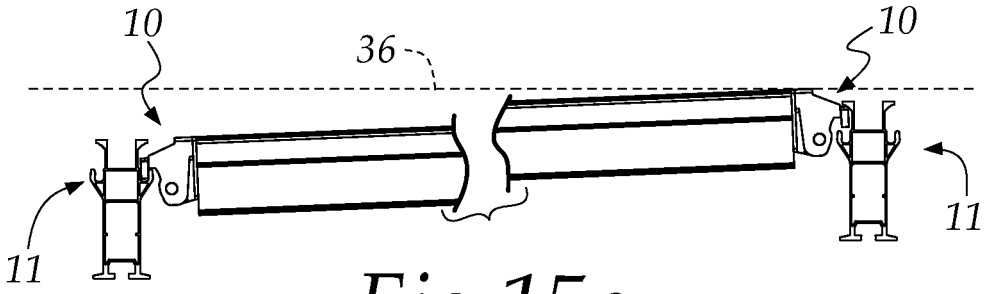
Figure 15D:
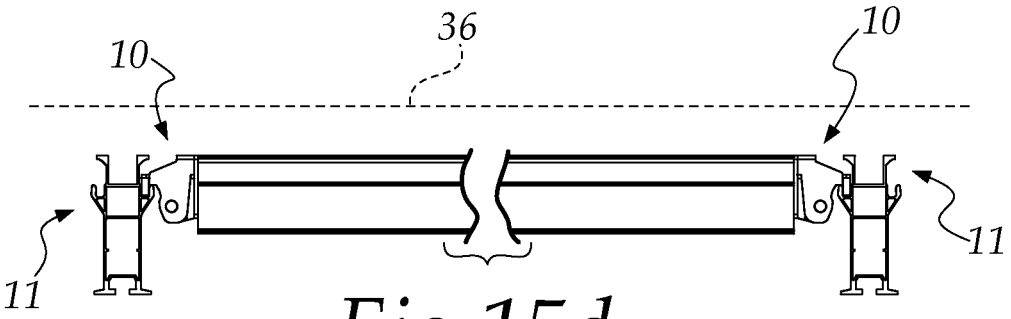

FIG. 14*e* shows the complete lowering of beam 12. The shape of the elements, i.e., the presence of the recesses 26 of the plates 24 and the placement of the mirror-symmetrical walls 14 in the accommodation region between the two plates 24, ensures in this lowering as well that the secondary beam falls back onto the supporting head and not accidentally to the ground, to be removed manually.

The safety of the system during the disassembly step is also guaranteed if the secondary beams rest on the lateral channels of the primary beams and not on the supporting heads.

The profile of the primary resting beams 11 and the geometry of the end portions 13 are such that during stripping the secondary beams, which can be coupled by nails to the panel, are retained, preventing them from falling.

In particular, as shown in FIGS. 15*a* to 15*d*, the upper wings 35 cause the primary resting beams 11 to lower as long as they have a free stroke, and then stop because they are blocked by the end portions 13 of the secondary beams 12. When coupling between the panel 36 and the beams 12 no longer occurs, said beams may be lowered and brought to the stripping position, allowing at the same time the primary resting beams 11 to complete lowering. During these steps the vertical portion 18 of the L-shaped element 17 causes the primary beams to be retained in a first step and then fall back into the lateral channel 33 when they are disengaged from the nails.

In this manner the system remains safe and avoids accidental falls of the elements that would occur instead if the primary beams were lowered completely in an initial step and with the risk that the secondary beams, by lowering at a later time, do not fall back with their end portions into the lateral channels.

The last steps (FIGS. 15*c* and 15*d*) show, after the disengagement of the nails from a part of the secondary beam 12, the consequent complete lowering of the primary beam 11. The secondary beam 12 would tend to rotate because it is retained only at one part, but the end portion of the part of the beam that is lowered remains safe inside the lateral channel 33 of the beam 11, avoiding accidental falls of the beam 12. The same occurs during the lowering of the other part.

FIGS. 18 and 19 show a different embodiment of the secondary beam, which is designated by the reference numeral 112.

In these figures, elements that correspond to those of the beams described above are designated by the same number increased by 100.

The secondary beam 112 comprises an end portion 113, at one or preferably both ends, which has:

- a pair of mirror-symmetrical walls 114, which are plate-like and vertical with respect to the installation position of the beam 112 and are crossed by a crossmember 115, preferably a rod, which protrudes externally from the mirror-symmetrical walls 114 with respective external portions 116,
- an L-shaped element 117, between the pair of mirror-symmetrical walls 114, with a vertical portion 118 that is directed downward, with respect to the installation position of the beam 112, and protrudes, in the direction of longitudinal extension of said beam 112, from the pair of mirror-symmetrical walls 114 and above the crossmember 115.

The L-shaped element 117 is adapted to be engaged with one of the lateral external wings 132 of the other primary beam 111.

The end portion 113 of the secondary beam 112 has an element 150 for resting on the other beam 111 (primary beam).

Such resting element 150 is arranged below the crossmember 115 and consists of a lamina which has, in the following order:

a first portion 151 that lies on a plane at right angles to the mirror-symmetrical walls 114 and is horizontal with respect to the installation position of the beam 112 and is fixed to the rest of the end portion by welding and/or riveting, a second portion 152, inclined with respect to the first portion 151, directed downward with respect to the installation position of the beam 112, and protruding in the direction of longitudinal extension of said beam 112, a third portion 153, which is vertical with respect to the installation position of the beam 112 and is directed upward, substantially parallel to/co-planar with the vertical portion 118.

Said third portion 153 is adapted to abut against the vertical wall 154 of the other beam 111 (primary beam), increasing the stability of the beam 112 (secondary beam).

In practice it has been found that the invention achieves the intended aim and objects, providing an apparatus that makes it possible to install a structure of beams for formwork with greater safety than the apparatuses currently known and that also makes it possible to facilitate and increase the safety of the stripping step after concrete casting.

The invention thus conceived is susceptible of numerous modifications and variations, all of which are within the scope of the appended claims; all the details may furthermore be replaced with other technically equivalent elements.

In practice, the materials used, so long as they are compatible with the specific use, as well as the contingent shapes and dimensions, may be any according to the requirements and the state of the art.

What is claimed is:

1. An apparatus for providing supporting structures for floor slab formwork, comprising at least one beam with at least one end portion which has:

a pair of mirror-symmetrical walls, which are plate-like-shaped and vertical with respect to an installation position of said beam and are crossed by a crossmember which protrudes externally from said mirror-symmetrical walls with respective external portions, an L-shaped element, between said pair of mirror-symmetrical walls, with a vertical portion that is directed downward, with respect to the installation position of said beam, and protrudes, in a direction of longitudinal extension of said beam, from said pair of mirror-symmetrical walls and above said crossmember.

2. The apparatus according to claim 1, wherein said mirror-symmetrical walls each have a recess which, with said vertical portion of said L-shaped element, forms a hollow for an end of said beam.

3. The apparatus according to claim 1, further comprising a supporting head which in turn comprises a post and a pair of plates at each of at least two mutually opposite parts of said post, which are arranged mirror-symmetrically with respect to each other and are adapted to delimit laterally a region for accommodating the end portion of said beam, each said pair of plates being provided with recesses for guiding insertion and containment for said external portions of said crossmember of said beam.

4. The apparatus according to claim 3, wherein said supporting head comprises said pair of plates at each of four parts of said post and in pairs on mutually opposite parts of said post.

5. The apparatus according to claim 3, wherein said post has a substantially quadrangular cross-section and said pairs of plates are positioned on planes which are inclined at 45° with respect to faces of said post.

6. The apparatus according to claim 3, wherein said pairs of plates are formed by:

two first metal plates which are each bent so as to form two portions on perpendicular planes and intersect each other so as to form an internal space in which said post is placed, two pairs of second metal plates, in each pair said second metal plates intersecting each other at right angles and the pairs being positioned on mutually opposite sides of said post.

7. The apparatus according to claim 1, wherein said beam has at least one lateral external wing that is directed upward and is extended along a length of said beam so as to form a corresponding lateral insertion channel for said vertical portion of said end portion of another beam.

8. The apparatus according to claim 7, wherein said end portion is adapted to rest on said lateral external wing by means of said recess of each of said mirror-symmetrical walls.

9. The apparatus according to claim 1, wherein said beam is provided with an upper channel filled with an insert made of recycled plastic material.

10. The apparatus according to claim 1, wherein said beam is provided with upper wings which are directed outward and are extended along entire length thereof.

11. The apparatus according to claim 1, wherein said end portion of said beam has a resting element for resting on another beam.

12. The apparatus according to claim 11, wherein said resting element is arranged below said crossmember and consists of a lamina having in the following order:

a first portion, which lies on a plane which is at right angles to said mirror-symmetrical walls and horizontal with respect to the installation position of said beam, a second portion, which is inclined with respect to said first portion, is directed downward with respect to the installation position of said beam and protrudes in the direction of longitudinal extension of said beam, a third portion, which is vertical with respect to the installation position of said beam and is directed upward, that is at least one of substantially parallel to said vertical portion and co-planar with said vertical portion.

* * * * *